United States Patent [19]

Wilson

[11] 4,201,382

[45] May 6, 1980

[54] SKIP ROPE

[76] Inventor: Bradford W. Wilson, 1642-A Coriander, Costa Mesa, Calif. 92626

[21] Appl. No.: 849,874

[22] Filed: Nov. 9, 1977

[51] Int. Cl.[2] ..... A63B 5/20

[52] U.S. Cl. ..... 272/75

[58] Field of Search ..... 272/75, 74, 8 R, 8 D, 272/8 N; 46/1 G, 47, 52; 74/551.9, 543, 545; 24/119, 122.3, 122.6, 128, 136 A; 174/93; 273/58 C, 26 E, 26 EA, 95 A, 95 AA, 97 R, 98

[56] References Cited

U.S. PATENT DOCUMENTS

| | | | |
|---|---|---|---|
| 85,514 | 1/1869 | Cross | 272/75 |
| 1,132,101 | 3/1915 | Kleinschmidt | 273/26 E |
| 1,651,057 | 11/1927 | Goldstein | 272/75 |
| 1,666,201 | 4/1928 | Goldstein | 272/75 |
| 2,253,075 | 8/1941 | Johnson | 272/75 |
| 2,688,651 | 9/1954 | Blake | 174/93 |
| 2,932,685 | 4/1960 | Raila et al. | 174/93 X |
| 3,907,287 | 9/1975 | Fox et al. | 273/26 E |

FOREIGN PATENT DOCUMENTS

| | | | |
|---|---|---|---|
| 1395500 | 3/1965 | France . | |
| 498972 | 11/1954 | Italy | 272/75 |
| 26028 | of 1908 | United Kingdom | 272/75 |

*Primary Examiner*—Richard C. Pinkham
*Assistant Examiner*—Arnold W. Kramer
*Attorney, Agent, or Firm*—Gordon L. Peterson

[57] ABSTRACT

A skip rope comprising an elongated flexible element having first and second end portions and handles attached, respectively, to the end portions. Each of the handles includes a tubular hand grip having a passage opening at the inner end of the hand grip and a tubular retainer in the passage of the tube. The first end portion of the flexible element extends through the tube and is attached to a bearing. The bearing is retained in the passage of the hand grip between the outer end of the retainer and a transverse wall of the hand grip.

2 Claims, 6 Drawing Figures

SKIP ROPE

BACKGROUND OF THE INVENTION

Skip ropes have been used for years as recreation and/or exercise devices. Although a skip rope may comprise nothing more than a length of an elongated flexible element, such as a rope, it is common practice to attach handles to the opposite ends of the rope to facilitate the rope skipping operation. To prevent the rope from becoming twisted in use, some skip ropes employ bearings for attaching the handles to the ends of the rope. It is known to use bearings of various designs, including ball bearings, for this purpose.

Although bearings have been used to rotatably attach the handles to the ends of the rope, it is surprisingly difficult to accomplish this within the constraints imposed by the relatively low retail selling prices of skip ropes. When a ball bearing is used, it is mounted at or adjacent the inner end of a handle. Unfortunately, this leaves the ball bearing exposed to dirt and other contaminants and it increases the likelihood of damage to the bearing. Moreover, the assembly techniques for this construction typically add significantly to the cost of the unit.

It is also known to add weights to the rope. This may be done to increase the centrifugal force generated in skipping and/or to widen the bottom of the arc of the rope. In this connection, it is known to attach members to the rope and to provide thickened regions along the rope. In any event, the weighted portion of the rope is characteristically, either totally immovable or subject to sliding along the rope due to the centrifugal force exerted thereon in jumping or to other factors. Moreover, the weights may appear unsightly and they add to the cost of the skip rope.

SUMMARY OF THE INVENTION

This invention provides a novel and inexpensive way of mounting a bearing on the handle of a skip rope. At the same time, the bearing is housed and protected to a large degree against damage and contaminants. The assembly technique is very simple, and it is virtually impossible to make an assembly error.

The skip rope of this invention may comprise an elongated flexible element having first and second end portions and first and second handles attached, respectively, to the first and second end portions. At least one, and preferably each, of the handles includes a tubular hand grip having inner and outer ends and a passage opening at least at the inner end of the hand grip. Although the hand grip may be of different sizes and configurations, it can advantageously take the form of a standard bicycle hand grip, and thus, has the advantage of being inexpensive and easily obtainable.

A bearing is housed within the tubular hand grip and is, therefore, protected from damage and contamination. To retain the bearing within the hand grip, a tubular retainer is provided in the passage of the hand grip. The tubular retainer has a passage therein and a shoulder in communication with a passage in the retainer. The first end portion of the elongated flexible element extends into the passage of the hand grip at the inner end of the hand grip and into the passage of the retainer.

First means cooperates with the shoulder of the retainer for holding the bearing between the shoulder and the first means. The bearing is cooperable with the first end portion of the elongated flexible element and mounts the hand grip for rotation relative to the first end portion of the elongated flexible element. The other end portion of the elongated flexible element may be similarly attached to a hand grip.

The first means which cooperates with the shoulder of the retainer can advantageously include a transverse wall on the hand grip. For example, the transverse wall may be an outer end wall of the hand grip which is characteristically provided on bicycle hand grips.

The tubular retainer can advantageously take the form of a tube. Although the shoulder can be provided on the tube in different ways, the simplest and least expensive way to provide it is to use the outer end of the tube as the shoulder. In this event, the bearing is retained between the end wall of the hand grip and the inner end of the tube.

This construction enables, but does not necessarily require, that the bearing be mounted within the hand grip closely adjacent the outer end of the hand grip. This construction is completely opposite to the conventional construction in which the bearing is mounted closely adjacent the inner end of the handle. By mounting the bearing adjacent the outer end of the hand grip, it is protected against damage and contamination and assembly is facilitated. In addition, it is believed that a somewhat different skipping action is obtained with the bearing at this location.

Although the hand grip may be rigid, it is preferably constructed of a flexible rubber or plastic material. The retainer, in addition to retaining the bearing, also preferably serves to support the hand grip, and to this end, is preferably constructed of rigid material. To further reduce the cost of the skip rope and to reduce the likelihood of cutting of the elongated flexible element, the retainer can advantageously be constructed of a suitable rigid plastic material, such as polyvinylchloride. The retainer has a smooth, inclined surface at the inner end against which the elongated flexible element bears during use to further reduce the likelihood of cutting of the elongated flexible element by the retainer.

This invention also provides a novel method of making the skip rope. According to the method of this invention, the retainer, bearing and elongated flexible element are preassembled and inserted part way into the hand grip. An adhesive is then applied to the exposed portion of the retainer. Because the bearing is at this time housed within the hand grip, there is virtually no likelihood that the glue will contact the bearing to impair its effectiveness. Thereafter, the retainer is pushed farther into the passage of the hand grip to bring the adhesive into contact with the hand grip. Preferably, the retainer is pushed into the hand grip until the inner ends of the retainer and hand grip are closely adjacent. The length of the retainer is selected so that in this position, the outer end of the retainer is spaced the appropriate distance from the transverse wall of the hand grip to properly retain the bearing. In other words, there is no danger that the bearing is too loosely retained or that it may be jammed against the transverse wall.

One advantageous, yet inexpensive, elongated flexible element includes a large number of woven plastic strands. To prevent the ends of the strands from becoming frayed, the method of this invention provides for heating the opposite ends of the elongated flexible element to fuse the strands together. In addition, by pushing the ends of the elongated flexible element against a flat, hard surface, a head or mushroom is formed and this can be used in retaining the bearing on the elongated flexible element.

This invention also provides a novel and aesthetic way of adding weight to any desired location along the elongated flexible element. The weight increases the centifugal force on the skip rope and widens the bottom of the U-shaped arc that the rope assumes during use. Moreover, the weight, once located, cannot be inadvertently moved but it can be easily intentionally moved by the user.

To accomplish this, one or more knots are tied in the elongated flexible element at the desired location. The knots add weight to the desired locations and can also be used to shorten the elongated flexible element. To conceal the knots and to add additional weight, each of the knots is housed within an enclosure. The enclosure cooperates with the knot housed thereby to prevent sliding movement of the enclosure along the elongated flexible element. However, the enclosure can be removed from the knot to permit the knot to be untied and retied in a new location. In this manner, the weights can be intentionally moved from one location to another.

The invention, together with further features and advantages thereof, may best be understood by reference to the following description taken in connection with the accompanying illustrative drawing.

DESCRIPTION OF THE PREFERRED EMBODIMENT

Figure 1:
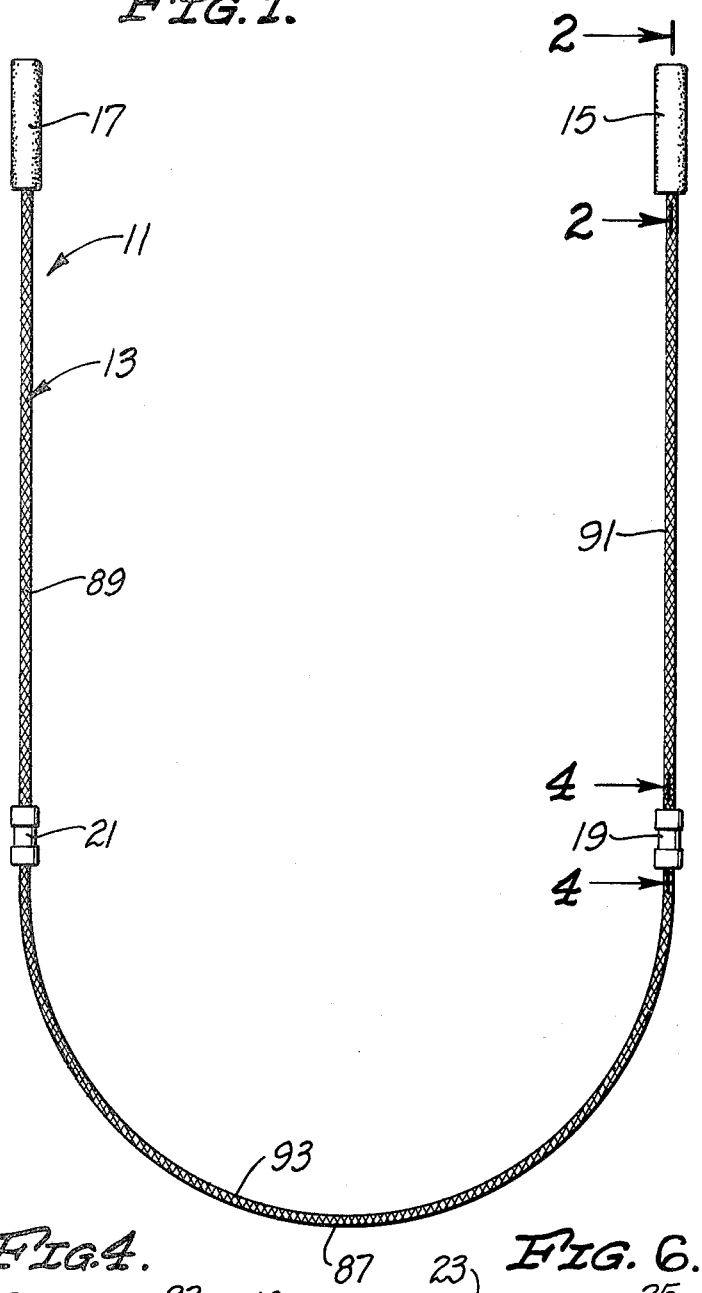
FIG. 1 is a front elevational view of a skip rope constructed in accordance with the teachings of this invention.

FIG. 1 shows a skip rope 11 which generally comprises an elongated flexible element 13, handles 15 and 17 attached to the opposite ends of the elongated flexible element 13, and weights 19 and 21 on the elongated flexible element. The handles 15 and 17 may be of identical construction and mounted in the same way, and accordingly, only the handle 15 is described in detail herein.

The handle 15 includes a tubular hand grip 23 and a tubular retainer 25. Although the hand grip 23 may be of different sizes and configurations, in the embodiment illustrated, it is a standard bicycle hand grip and is constructed of a resilient plastic material. The hand grip 23 has a continuous, unperforated peripheral wall 27 containing the usual bumps 29 to facilitate manually grasping the hand grip. The hand grip 23 has an axial cylindrical passage 31 which opens at an inner end 33 of the hand grip and extends almost completely through the hand grip to a location closely adjacent an outer end 35 of the hand grip. The hand grip 23 has a transverse wall, which in the embodiment illustrated, is a transverse end wall 37. Although the transverse end wall 37 has an aperture 39 extending therethrough and communicating with the passage 31, the aperture 39 can be eliminated, if desired.

The retainer 25 has an outer end defining an annular shoulder 41 with the shoulder 41 being adjacent the transverse end wall 37. The retainer 25 can form the shoulder 41 in other ways, if desired. In the embodiment illustrated, the retainer 25 has an inner end 43 which is flush with the inner end 33 of the hand grip 23. Although the retainer 25 can be of different configurations, in the embodiment illustrated, it is in the form of a hollow cylindrical tube having an axial cylindrical passage 45 extending therethrough coaxial with the passage 31. The retainer 25 is constructed of a rigid plastic material, such as polyvinylchloride and it has a smooth inclined surface 47 at the inner end 43 which flares radially outwardly as it extends axially inwardly. The retainer 25 can be suitably retained within the passage 31 in any suitable manner, such as by an adhesive.

A bearing 49 rotatably couples the handle 15 to an end portion 51 of the elongated flexible element 13 for rotation about an axis which is generally coaxial with the hand grip 23 and the retainer 25. The bearing 49 can be of different types and, in the embodiment illustrated, is a ball bearing which includes an outer race 53, an inner race 55 and a plurality of balls 57 between the races.

The end portion 51 of the elongated flexible element 13 extends through the inner race 55. A clamp 59 extends at least part way around the end portion 51 adjacent an enlarged head 61 of the end portion. The clamp 59 bears on the inner race to prevent the elongated flexible element 13 from being withdrawn from the inner race. The elongated flexible element 13 fits snugly within the inner race 55. Although the elongated flexible element may be allowed to slide somewhat in the inner race 55, the clamp 59 prevents the elongated flexible element from being pulled downwardly from the position shown in FIG. 2 out of the bearing 49, and in that sense, the bearing is coupled or attached to the elongated flexible element.

Figure 2:
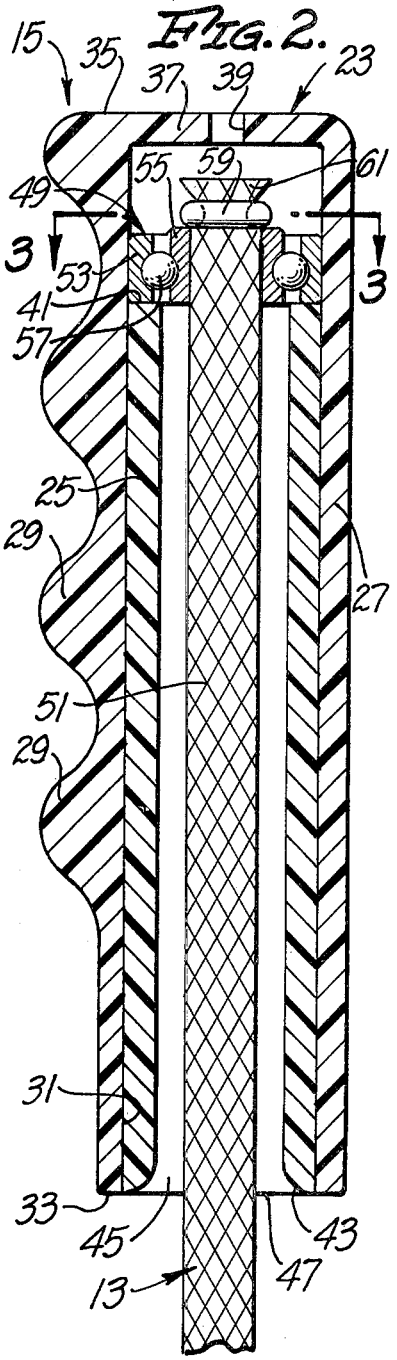
FIG. 2 is an enlarged fragmentary sectional view taken generally along line 2—2 of FIG. 1 and showing one of the handles of the skip rope.
Figure 4:
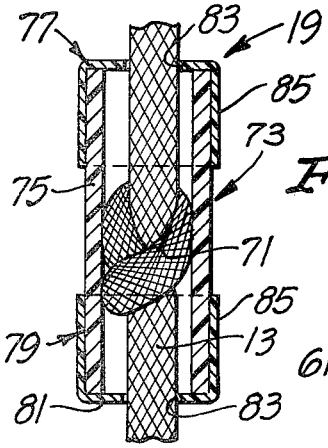
FIG. 4 is an enlarged fragmentary sectional view taken generally along line 4—4 of FIG. 1.

The bearing 49 is retained between the transverse end wall 37 and the shoulder 41. The bearing 49 is not attached to either the hand grip 23 or the retainer 25; however, in normal use of the skip rope 11, the bearing 49 rests due to centrifugal force and gravity on the shoulder 41 as shown in FIG. 2. Sufficient clearance is provided between the shoulder 41 and the transverse end wall 37 to accommodate the bearing 49 and the head 61 of the elongated flexible element 13. As shown in FIG. 2, only the outer race 53 rests on the shoulder 41. It is apparent from the foregoing that the handle 15 can rotate about a rotational axis coaxial with the retainer 25 relative to the elongated flexible element 13.

Figure 5:
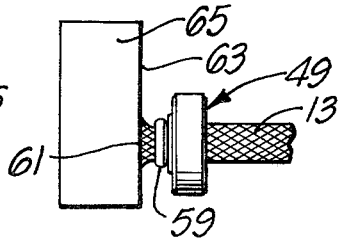
FIG. 5 is a front elevational view showing one step in the process of this invention.
Figure 3:
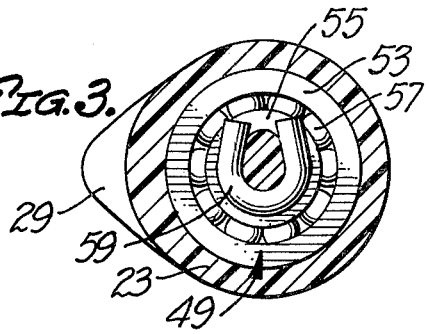
FIG. 3 is a sectional view taken generally along line 3—3 of FIG. 2.

The elongated flexible element 13 can be constructed of various different materials and may be a rope. However, in the embodiment illustrated, it is constructed of a large number of woven plastic strands. The head 61 can advantageously be formed, at least in part, by heating one end of the elongated flexible element, with a flame or otherwise, sufficiently to make the plastic material flowable and then forcing the heated end of the elongated flexible element 13 against a rigid flat surface 63 of an object 65 as shown in FIG. 5. This process is carried out after the elongated flexible element 13 has been inserted through the inner race 55. The clamp 59 can be applied before or after the head 61 is formed. In addition to forming the head 61, this operation fuses together the ends of the strands to prevent the elongated flexible element 13 from fraying.

Figure 6:
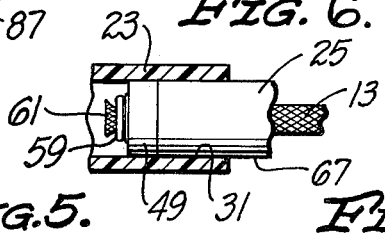
FIG. 6 is a fragmentary sectional view of one of the handles during assembly.

The retainer 25 is preferably adhesively secured to the hand grip 23. To prevent the bearing 49 from getting adhesive on it, the retainer 25 with the bearing 49 and elongated flexible element 13 in position (as shown in FIG. 6) is inserted part way into the passage 31 of the hand grip 23. This leaves an exposed portion 67 of the retainer 25 on which adhesive can be applied. Thereafter, the retainer 25 is inserted the rest of the way into the passage 31 to bring the adhesive into contact with the hand grip 23. The length of the retainer 25 is selected so that it should be pushed into the passage 31 until the inner ends 33 and 43 are substantially flush as shown in FIG. 2. This assures that the proper spacing between the shoulder 41 and the transverse end wall 37 will be obtained.

The weights 19 and 21 are identical and, accordingly, only the weight 19 is described in detail herein. The weight 19 includes a knot 71 of any kind tied in the elongated flexible element 13 and an enclosure 73. In the embodiment illustrated, the enclosure 73 includes a tubular peripheral wall 75 and end caps 77 and 79. Each of the end caps 77 and 79 has an end wall 81 with an aperture or opening 83 extending therethrough and a peripheral flange 85. Although other arrangements are possible, in the embodiment illustrated, the flanges 85 of the end caps 77 and 79 surround and embrace the opposite end portions of the peripheral wall 75. At least one of the end caps 77 and 79 should be removable from the peripheral wall 75, and in the embodiment illustrated, both of the end caps are removable and are normally retained in position on the peripheral wall by frictional forces. Although various materials can be used for the enclosure 73, in the embodiment illustrated, the peripheral wall 75 is constructed of a rigid plastic material, and the end caps 77 and 79 are constructed of a flexible, somewhat resilient plastic material.

The enclosure 73 completely houses the knot 71. There is sufficient room within the enclosure 73 so that more than one knot can be housed in the enclosure 73. The knot 71 is completely concealed by the enclosure 73. The elongated flexible element 13 projects through the apertures 83 of the end caps 77 and 79. The enclosure 73 can slide a limited distance along the elongated flexible element 13 with such movement being resisted solely by the force of friction between the knot 71 and the peripheral wall 75. However, if the enclosure 73 is moved far enough so that the end wall 81 of one of the end caps 77 and 79 comes into contact with the knot 71, further movement of the enclosure is arrested. In this manner, the knot 71 cooperates with the enclosure 73 to retain the enclosure 73 in a predetermined location and to prevent movement of the enclosure away from a position in which the enclosure would no longer house and conceal the knot 71.

The location of the weights 19 and 21 can be varied; however, in the embodiment illustrated, the weight 19 is between the mid-point 87 of the elongated flexible element 13 and the handle 15, and the weight 21 is between the mid-point 87 and the handle 17. With the skip rope 11 in the position shown in FIG. 1, the elongated flexible element 13 includes side sections 89 and 91 and a generally arcuate U-shaped central section 93. In the embodiment illustrated, the weights 19 and 21 are symmetrically positioned closely adjacent the juncture of the central section 93 and the side sections 91 and 89, respectively.

If it is desired to move the location of the knot 71 to obtain a different effect while utilizing the skip rope 11, one of the removable end caps 77 and 79 is manually removed from the peripheral wall 75. The peripheral wall 75 and the unremoved end cap can then be slid off of the knot 71 to permit this knot to be untied and a new knot to be tied at a new location. Thereafter, the enclosure 73 is manually assembled over the newly tied knot.

The skip rope 11 can be used in a conventional manner. The bearings 49 allow the handles 15 and 17 to rotate during use of the skip rope as described above. At all times, the bearings 49 are housed within their associated handle and protected from damage and contaminants. The weights 19 and 21 add additional weight to the elongated flexible element 13 so that the centrifugal force generated during the rope skipping operation is increased.

Although an exemplary embodiment of the invention has been shown and described, many changes, modifications and substitutions may be made by one having ordinary skill in the art without necessarily departing from the spirit and scope of this invention.

I claim:

1. A skip rope comprising:

an elongated flexible element having first and second end portions;

first and second handles;

first means for attaching the first handle to the first end portion of the elongated flexible element;

second means for attaching the second handle to the second end portion of the elongated flexible element;

a first knot formed in said elongated flexible element intermediate said first handle and the mid-point of said elongated flexible element;

a second knot formed in said elongated flexible element intermediate said second handle and the mid-point of said elongated flexible element;

first and second enclosures housing said first and second knots, respectively;

each of said enclosures having a peripheral wall with openings at the opposite ends thereof to permit the passage of the elongated flexible element through said enclosure and means cooperating with the associated knot for retaining the enclosure at a predetermined location along the elongated flexible element;

said retaining means for said enclosures including an end wall removably attached to said peripheral wall whereby upon removal of said end wall, the enclosure can be moved along the elongated flexible element independently of said knot to permit the knot to be untied and retied at a new location with the enclosure being movable along the elongated flexible element to house the retied knot; and said enclosures including an additional end wall attached to said peripheral wall of the enclosures, each of said end walls having an opening through which the elongated flexible element extends.

2. A skip rope as defined in claim 1 wherein said knots are spaced substantially from each other and from said handles.

* * * * *